US006237166B1

(12) United States Patent
Stalfire

(10) Patent No.: US 6,237,166 B1
(45) Date of Patent: May 29, 2001

(54) SUBMERSIBLE LIFE SAVING PLATFORM

(75) Inventor: Dan Stalfire, 1108 Harvest Glen Dr., Plano, TX (US) 75023

(73) Assignee: Dan Stalfire, Plano, TX (US)

( * ) Notice: Subject to any disclaimer, the term of this patent is extended or adjusted under 35 U.S.C. 154(b) by 0 days.

(21) Appl. No.: 09/459,042

(22) Filed: Dec. 10, 1999

(51) Int. Cl.[7] ..... E04H 4/00
(52) U.S. Cl. ..... 4/496; 472/117
(58) Field of Search ..... 4/496, 494, 487, 4/506; 14/71.1; 114/258, 362; 119/843; 472/116, 117

(56) References Cited

U.S. PATENT DOCUMENTS 3,587,123 * 6/1971 O'Boyle .
3,891,053 * 6/1975 Burton .
4,538,314 * 9/1985 Baranowski ..... 14/71.1
4,630,709 * 12/1986 Taylor ..... 472/117
4,805,898 * 2/1989 Jacober et al. ..... 4/506
5,466,156 * 11/1995 Ramirez ..... 472/116
5,735,748 * 4/1998 Meyers et al. ..... 472/117
5,829,380 * 11/1998 Smith ..... 114/362

FOREIGN PATENT DOCUMENTS

WO 98/55356 * 12/1998 (WO) .

* cited by examiner

*Primary Examiner*—Henry J. Recla
*Assistant Examiner*—Khoa Huynh
(74) *Attorney, Agent, or Firm*—Haynes and Boone, LLP

(57) ABSTRACT

Submersible life saving platforms are disclosed having a central platform, two support legs disengageably connected to the each bottom front side of the central platform, and two rear support legs connected to the bottom side of the central platform. The bottom central platform is covered in a non-skid surface. The support bottom two legs include a mounting hole by which a pin secures them to the base, while an anchor strap holds the unit firmly in place.

14 Claims, 1 Drawing Sheet

SUBMERSIBLE LIFE SAVING PLATFORM

FIELD OF THE INVENTION

The present invention relates to submersible life saving platforms, and in particular, a slanted platform to be placed on the side of a structure adjacent to a body of water.

BACKGROUND OF THE INVENTION

Two important considerations for all life saving devices designed for animals are convenience and ease of use. Relating to convenience, a life saving device must be easily accessible so that it can be immediately put in place for use by the owner. A life saving structure must also be easily stored since an adult owner is not likely to leave it in place throughout the year.

Larger devices such as pool nets or alarm sensors often pose a greater problem with regards to convenience, and affordability. The larger devices tend to be bulky, which makes it difficult to move them around, and sometimes makes it prohibitive to move them in and out of the water to other locations. Bulky devices also take up much storage space.

SUMMARY OF THE INVENTION

In contrast to the prior art, the present invention provides a submersible life saving platform that includes solid base, coated in an anti-skid surfacing. This submersible life saving platform can be easily and quickly disassembled into a compact configuration. As a result, the submersible life saving platform according to the present invention is convenient to assemble, to use, to move around, and to disassemble and store, thereby making it ideal for use at home, on a boat, at a beach house, at a lake, at an animal ranch, or many other locations.

In order to accomplish the objects of the present invention, the submersible life saving platform according to the present invention has a central platform, support leg(s) disengageably connected to a front side of the central platform, and rear support leg(s) connected to the bottom side of the central platform. The bottom central platform may be covered in a non-skid surface. The bottom two legs may be attached to the base by use of a mounting hole and a cotter pin, and may be held firmly in place with an anchor strap.

In one embodiment according to the present invention, the bottom surfaces of the support legs and support panels rest on the surface when the structure is deployed, with the central platform submerged at a proper angle to allow ease of use by an animal.

Submersible life saving platforms can serve to fill a variety of needs. The unit is designed to provide a safe means for escape from drowning in a body of water. The submersible life saving platform has a portion of its length submerged to allow an animal a way to crawl out of the water. This platform can function in several different situations. Situations like mounting on a swimming pool deck to allow a way out for an animal that has fallen into the pool. Mounting on a dock to allow any animal that has gone into the water a way out. Placement on a boat to provide a person's pet an exit from the water. Use at a farm. Placed on a water trough to allow livestock a way to avoid drowning when they fall in. This unit can also be mounted on a bulkhead to provide an escape from the water.

The wide-ranging uses for these submersible life saving platforms can be attributed to the performance, convenience and security that these structures provide. When properly deployed, these structures are stable and can be used as a true life saving device without the fear of collapse. These structures are also easily installed and have removable leg supports in the front to allow the owner to conveniently store the structure. The lightweight nature of the materials used to make these structures makes it convenient for them to be moved from one location to another. These structures also provide a variety of uses. For example, a dog can use the structure to escape drowning in a swimming pool because it can not find the steps, nor can it lift its weight vertically to escape the pool.

This submersible life saving platform will primarily be used to provide animals a means of escape from a body of water. In addition, the submersible life saving platform provides an increased variety of security and durability, and yet is simple in construction and can be conveniently deployed, collapsed, and stored.

Therefore, in accordance with the previous summary, objects, features and advantages of the present invention will become apparent to one skilled in the art from the subsequent description and the appended claims taken in conjunction with the accompanying drawings.

DETAILED DESCRIPTION OF THE PREFERRED EMBODIMENTS

The present invention can be described with several examples given below. It is understood, however, that the examples below are not necessarily limitations to the present invention, but are used to describe typical embodiments of operation. Although the preferred embodiment is shown implemented alongside a swimming pool, the present invention can easily be adapted for use on a boat, or a dock or other similar surface adjacent to a body of water.

Figure 1:
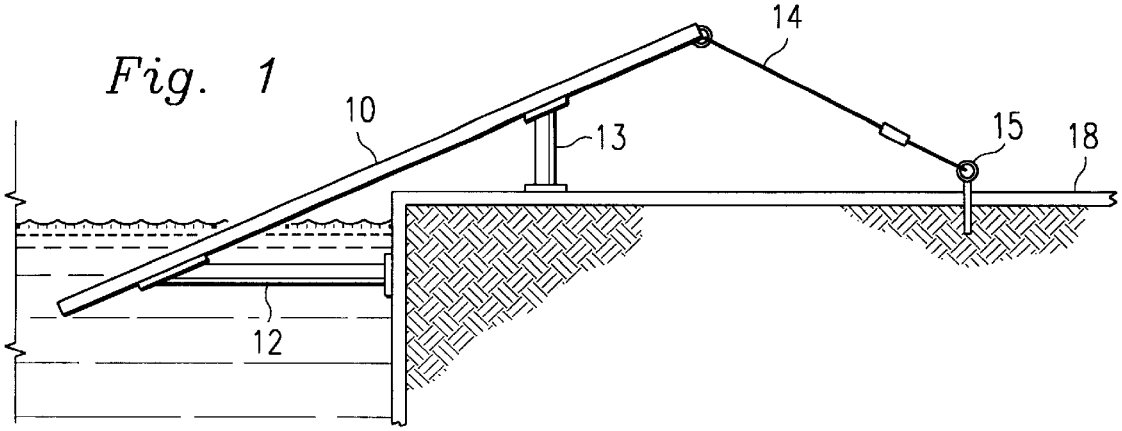
FIG. 1 is a side view of the preferred embodiment.

Now referring to FIG. 1 the platform 10 is supported by top leg(s) 13 and bottom leg(s) 12. Preferably, either the top support 13 or the bottom supports 12 have at least two support legs in order to more easily balance the platform 10. In addition, the anchor strap 14 helps stabilize the platform 10 and is attached to the pool deck 18 by an anchor 15.

Figure 2:
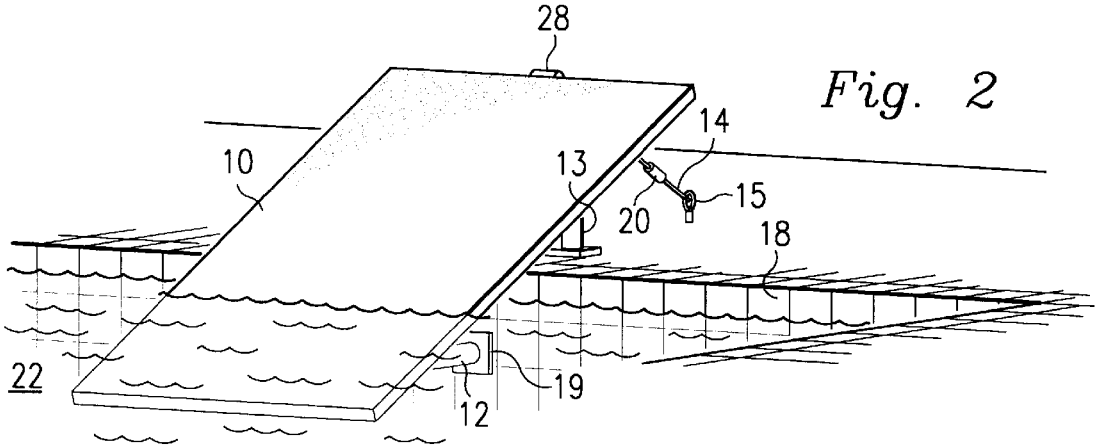
FIG. 2 is a front plan view of the preferred embodiment.

FIG. 2 shows a front plan view of the submersible life saving platform. The platform 10 is shown with top support leg 13 and bottom support leg 12. The bottom support leg 12 is also shown with an attached flat portion 19 that butts up against a wall of the swimming pool 18. The platform 10 is also shown partially submerged in water 22 of the swimming pool 18. In addition, an anchor strap attachment 20 is shown in a middle portion of the anchor strap 14. The anchor strap attachment 20 can be used to loosen or tighten the anchor strap 14 from the anchor 15 to the platform 10.

Figure 3:
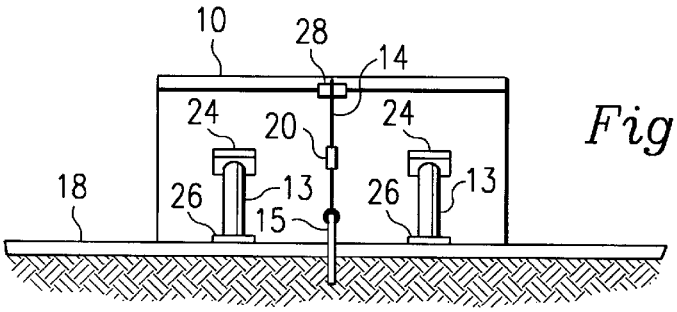
FIG. 3 is a rear view of the preferred embodiment.

FIG. 3 shows a rear view of the submersible life saving platform. The top support leg 13 is shown attached to the platform 10 by a base portion 24 and rests on a brace portion 26 that sits on the deck of the swimming pool 18. In addition, the anchor strap 14 and the attachment 20 are attached to the platform 10 by a hinge or eyelet 28 and to the deck of the swimming pool 18 by the anchor 15.

Although the top support assembly is shown with two separate support legs, the platform could also be balanced by a single support leg as long as the strap balanced the platform and preferably with two bottom support legs. However, another alternative could have a single top support and a single bottom support as long as the portions of the support, along with the tension of the anchor strap were sufficiently wide enough to keep the equilibrium of the platform. Another alternative could include two anchor straps to help keep the platform balanced.

In summary, the present invention provides a submersible life saving platform that includes sturdy base that is preferably coated in an anti-skid surfacing. In order to provide a lightweight device, the platform 10 can be made of a lightweight, but sturdy material such as aluminum, sturdy plastic, or other lightweight materials. In addition, the platform 10 could also be made of a porous, but buoyant material. The design of the submersible life saving platform facilitates easy and quick disassembly into a compact configuration. As a result, the submersible life saving platform is convenient to assemble, to use, to move around, and to disassemble and store, thereby making it ideal for use at home, on the boat, the beach house, the lake, on an animal ranch, and at many other locations.

Referring back to FIG. 1, the preferred embodiment includes the central platform 10, two support legs 13 disengageably connected to each bottom front side of the central platform 10, and two rear support legs 12 permanently connected to the bottom side of the central platform 10. The bottom central platform 10 is covered in a non-skid surface. The support bottom two legs 13 include a mounting hole by which a cotter pin that attach each of them to the base portion 24 (shown in FIG. 3), while an anchor strap 14 holds the platform 10 firmly in place.

In one embodiment according to the present invention, the bottom surfaces 19, 24 of the support legs 12, 13, respectively, rest on the surface 18 when the structure 10 is deployed, with the central platform 10 submerged at a proper angle to allow ease of use by an animal.

The preferred embodiment of the submersible life saving platform has a length of about 5 feet and roughly about 2 feet of its length is submerged to allow the animal a way to crawl out of the water.

In addition, the platform can function in several different situations like mounting on a swimming pool deck to allow animals that have fallen into the pool a way out. Another use is to mount it on a dock to allow any animal that has gone into the water a way out. The present invention can also be places on a boat to provide a pet an exit from the water. The present invention can also be employed at a farm. Another use is to place the platform on a water trough to allow livestock a way to avoid drowning when they fall in. This unit can also be mounted on a bulkhead to provide an escape from the water.

The wide-ranging uses for these submersible life saving platforms can be attributed to the performance, convenience and security that these structures provide. When properly deployed, these structures are stable and can be used as a true life saving device without the fear of collapse. These structures are easily installed and have removable leg supports in the front to allow the owner to conveniently store the structure. The lightweight nature of the materials used to make these structures makes it convenient for them to be moved from one location to another. These structures also provide much variety of use. For example, a dog can use the structure to escape drowning in a swimming pool because it can not find the steps, nor can it lift its weight vertically to escape the pool.

Although the submersible life saving platform was primarily designed to provide animals a means of escape from a body of water, the platform provides increased security and durability, and yet is simple in construction and can be conveniently deployed, collapsed, and stored. In addition, the platform could also ideally benefit small children and handicapped persons that could not use the stairs or other conventional means of exiting a body of water.

It is understood that several modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A submersible life saving platform comprising:

a platform having a slanted flat portion with an upper and a lower surface, said platform having a top section adapted to be placed on a stable object adjacent to a body of water, and a bottom section adapted to extend over said body of water;

a plurality of removably attached top supports fixed to said lower surface of said top section and adapted to be placed against the stable object;

a plurality of bottom supports fixed to said lower surface of said bottom section and adapted to be placed against the stable object; and an adjustable anchor strap attached to the lower surface of said top section and adapted to be attached to the stable object.

2. The platform of claim 1 wherein the plurality of top supports includes two supports and are attached to the top of the flat portion by a keyhole and a removable pin.

3. The platform of claim 1 wherein the plurality of bottom supports includes two supports and are attached to the bottom of the flat portion by a hinge in each support that allow the two supports to fold adjacent to the platform.

4. The platform of claim 1 wherein the flat portion includes a non-slippery surface.

5. The platform of claim 1 wherein the flat portion is slanted to an angle that allows more than 20% of the flat portion to be submerged in the body of water.

6. The platform of claim 1 wherein the anchor includes an adjustable lever that tightens an anchor strap in order to stabilize the platform.

7. A submersible life saving platform comprising:

a platform having a slanted flat portion with an upper and a lower surface, said platform having a top section adapted to be placed on a stable object adjacent to a body of water, and a bottom section adapted to extend over said body of water;

a set of two removably attached top supports fixed to said lower surface of said top section and adapted to be placed against the stable object;

a set of two bottom supports fixed to said lower surface of said bottom section and adapted to be placed against the stable object; and an adjustable anchor strap attached to the lower surface of said top section and adapted to be attached to the stable object.

8. The platform of claim 7 wherein two top supports are attached to the top of the flat portion by a keyhole and a removable pin.

9. The platform of claim 7 wherein the two bottom supports are attached to the bottom of the flat portion by a hinge in each support that allow the two bottom supports to fold adjacent to the platform.

10. The platform of claim 7 wherein the flat portion includes a non-slippery surface.

11. The platform of claim 7 wherein the flat portion is slanted to an angle that allows more than 20% of the flat portion to be submerged in the body of water.

12. The platform of claim 7 wherein the anchor includes an adjustable lever that tightens an anchor strap in order to stabilize the platform.

13. A submersible life saving platform comprising:

a platform having a slanted flat portion with an upper and a lower surface, said platform having a top section adapted to be placed on a stable object adjacent to a body of water, and a bottom section adapted to extend over said body of water;

a non-slippery surface on the platform;

a set of two top supports attached to said lower surface of said top section by a keyhole and a removable pin and adapted to be placed against the stable object;

a set of two bottom supports are attached to said lower surface of said bottom section by a hinge in each support and adapted to be placed against the stable object and wherein the hinge allows the two bottom supports to fold adjacent to said lower surface of said bottom section; and an anchor strap attached to the lower surface of said top section and adapted to be attached to the stable object wherein the anchor strap includes an adjustable lever that tightens said anchor strap in order to stabilize the platform.

14. The platform of claim 13 wherein the flat portion is slanted to an angle that allows more than 20% of the flat portion to be submerged in the body of water.

* * * * *